US010964241B2

(12) United States Patent
Kim et al.

(10) Patent No.: US 10,964,241 B2
(45) Date of Patent: Mar. 30, 2021

(54) MURA CORRECTION SYSTEM

(71) Applicant: Silicon Works Co., Ltd., Daejeon (KR)

(72) Inventors: Ki Taek Kim, Daejeon (KR); Jun Young Park, Daejeon (KR); Doo Hwa Jang, Daejeon (KR); Seung Wan Yu, Daejeon (KR); Do Yeon Kim, Daejeon (KR)

(73) Assignee: Silicon Works Co., Ltd., Daejeon-si (KR)

( * ) Notice: Subject to any disclaimer, the term of this patent is extended or adjusted under 35 U.S.C. 154(b) by 0 days.

(21) Appl. No.: 16/723,103

(22) Filed: Dec. 20, 2019

(65) Prior Publication Data

US 2020/0211429 A1 Jul. 2, 2020

(30) Foreign Application Priority Data

Dec. 26, 2018 (KR) ..... 10-2018-0169626

(51) Int. Cl.
*G09G 3/00* (2006.01)

(52) U.S. Cl.
CPC ..... *G09G 3/006* (2013.01); *G09G 2320/0233* (2013.01); *G09G 2320/0285* (2013.01); *G09G 2320/0693* (2013.01)

(58) Field of Classification Search
CPC ..... G09G 2320/0233; G09G 3/006; G09G 2320/0693; G09G 2320/0285; G09G 3/20; G09G 2320/0242; G06T 7/0004
See application file for complete search history.

(56) References Cited

U.S. PATENT DOCUMENTS

2008/0284794 A1 11/2008 Wang et al.
2012/0026315 A1* 2/2012 Lee ..... G09G 3/006 348/92
2014/0184671 A1* 7/2014 Lee ..... G09G 3/006 345/697
2015/0348458 A1* 12/2015 Tian ..... G09G 3/2007 345/690
2016/0247432 A1* 8/2016 Hu ..... G09G 5/02
2017/0193933 A1* 7/2017 Zhang ..... G09G 3/36
2018/0240440 A1* 8/2018 Furihata ..... G09G 5/395
2018/0322834 A1* 11/2018 Zhang ..... G09G 3/2007

FOREIGN PATENT DOCUMENTS

KR 10-1567424 A 5/2010
KR 10-1374989 B 3/2014
KR 10-1747405 B 6/2017
KR 2017-0087566 A 7/2017
KR 2017-0106527 A 9/2017
KR 2014-0076963 A 3/2019
KR 2019-0070936 A 6/2019
KR 2017-0128573 A 11/2019

* cited by examiner

*Primary Examiner* — Sanjiv D. Patel
(74) *Attorney, Agent, or Firm* — Polsinelli PC

(57) ABSTRACT

A Mura correction system which detects and corrects Mura in a detection image obtained by photographing a display panel. The Mura correction system detects a Mura block by checking, based on a brightness value, detection images obtained by photographing test images displayed on a display panel, generates coefficient values of coefficients of a Mura correction equation, and generates Mura correction data including a position value of the Mura block and the coefficient values of the coefficients of the Mura correction equation.

13 Claims, 7 Drawing Sheets

MURA CORRECTION SYSTEM

CROSS-REFERENCE TO RELATED APPLICATIONS

The present application claims priority to Korean Application No. 10-2018-0169626, filed Dec. 26, 2018 the contents of which are hereby incorporated by reference as set for fully herein.

BACKGROUND

1. Technical Field

Various embodiments generally relate to a Mura correction system, and more particularly, to a Mura correction system which detects Mura in a detection image obtained by photographing a display panel and corrects a Mura defect.

2. Related Art

Recently, LCD panels and OLED panels have been widely used as display panels.

Mura may occur in a display panel due to an error in a manufacturing process, or the like. Mura means that a display image has non-uniform luminance in the form of a spot at a pixel or a certain area. A defect that Mura occurs is referred to as a Mura defect.

The Mura defect needs to be detected and corrected to allow the display panel to have improved image quality.

SUMMARY

Various embodiments are directed to a Mura correction system which detects a Mura block based on a brightness value in a detection image obtained by detecting a test image displayed on a display panel and generates Mura correction data to be applied to a quadratic Mura correction equation for correcting the brightness value of the Mura block.

Also, various embodiments are directed to a Mura correction system which generates, as Mura correction data, a position value of a Mura block and coefficient values of coefficients of a quadratic Mura correction equation for correcting a brightness value of the Mura block, and approximates the sum of a Mura measurement value and a Mura correction value for each gray level of the Mura block, maximally to an average pixel brightness value of a display panel, by applying an adaptive range capable of changing a brightness representation range of the Mura block, to a coefficient of the Mura correction equation.

Further, various embodiments are directed to a Mura correction system which detects a Mura pixel in a block based on a brightness value in a detection image obtained by detecting a test image displayed on a display panel and generates Mura pixel correction data to be applied to a quadratic Mura pixel correction equation for correcting the brightness value of the Mura pixel.

Moreover, various embodiments are directed to a Mura correction system which generates, as Mura pixel correction data, a position value of a Mura pixel and coefficient values of coefficients of a quadratic Mura pixel correction equation for correcting a brightness value of the Mura pixel, and approximates the sum of a pixel measurement value and a pixel correction value for each gray level of the Mura pixel, maximally to an average pixel brightness value, by applying an adaptive range capable of changing a brightness representation range of the Mura pixel, to a coefficient of the Mura pixel correction equation.

In an embodiment, a Mura correction system may include: a test image supply unit configured to provide test images for gray levels, to a display panel; an image detection unit configured to provide detection images obtained by photographing the test images displayed on the display panel; and a Mura correction device configured to detect a Mura block which has Mura, by checking, based on a brightness value, each detection image in a block unit including a plurality of pixels, generate coefficient values of coefficients of a Mura correction equation as a quadratic equation for correcting a measurement value of the Mura block for each gray level to an average pixel brightness value of the display panel, set a first coefficient among the coefficients of the Mura correction equation to include adaptive range bits capable of changing a brightness representation range of the Mura block such that a sum of a Mura measurement value for the Mura block and a Mura correction value approximates to the average pixel brightness value, and generate Mura correction data including a position value of the Mura block and the coefficient values of the coefficients of the Mura correction equation.

In an embodiment, a Mura correction system may include: a Mura correction device configured to receive a detection image corresponding to a test image for each gray level of a display panel, and generate Mura correction data for a Mura block.

The Mura correction device may include: a Mura block detector configured to detect a Mura block which has Mura, by checking, based on a brightness value, each detection image in a block unit including a plurality of pixels; a first coefficient generator configured to generate coefficient values of coefficients of a Mura correction equation as a quadratic equation for correcting a measurement value of the Mura block for each gray level to an average pixel brightness value of the display panel, and set a first coefficient among the coefficients of the Mura correction equation to include adaptive range bits capable of changing a brightness representation range of the Mura block such that a sum of a Mura measurement value for the Mura block and a Mura correction value approximates to the average pixel brightness value; a memory configured to store Mura correction data including a position value of the Mura block and the coefficient values of the coefficients of the Mura correction equation; and an output circuit configured to output the Mura correction data to a driver for driving the display panel.

According to the embodiments of the disclosure, the Mura correction system may detect a Mura block of a display panel and a Mura pixel in a block, and may generate coefficient values of coefficients of a quadratic Mura correction equation for correcting a brightness value of the Mura block and coefficient values of coefficients of a quadratic Mura pixel correction equation for correcting a brightness value of the Mura pixel.

According to the embodiments of the disclosure, a position value of the Mura block and the coefficient values of the coefficients of the Mura correction equation may be generated as Mura correction data, and a position value of the Mura pixel and the coefficient values of the coefficients of the Mura pixel correction equation may be generated as Mura pixel correction data. In the case where a substantial change occurs in the brightness value of the Mura block or the Mura pixel for each gray level, an adaptive range capable of changing a brightness representation range of each of the Mura block and the Mura pixel may be applied to a coefficient of each of the Mura correction equation and the Mura pixel correction equation.

According to the embodiments of the disclosure, since the Mura correction data and the Mura pixel correction data to be provided to a driver which drives the display panel are generated to be able to be applied to Mura correction even in the case where a substantial change occurs in the brightness value of the Mura block or the Mura pixel, it is possible to improve the image quality of the display panel.

DETAILED DESCRIPTION

Figure 1:
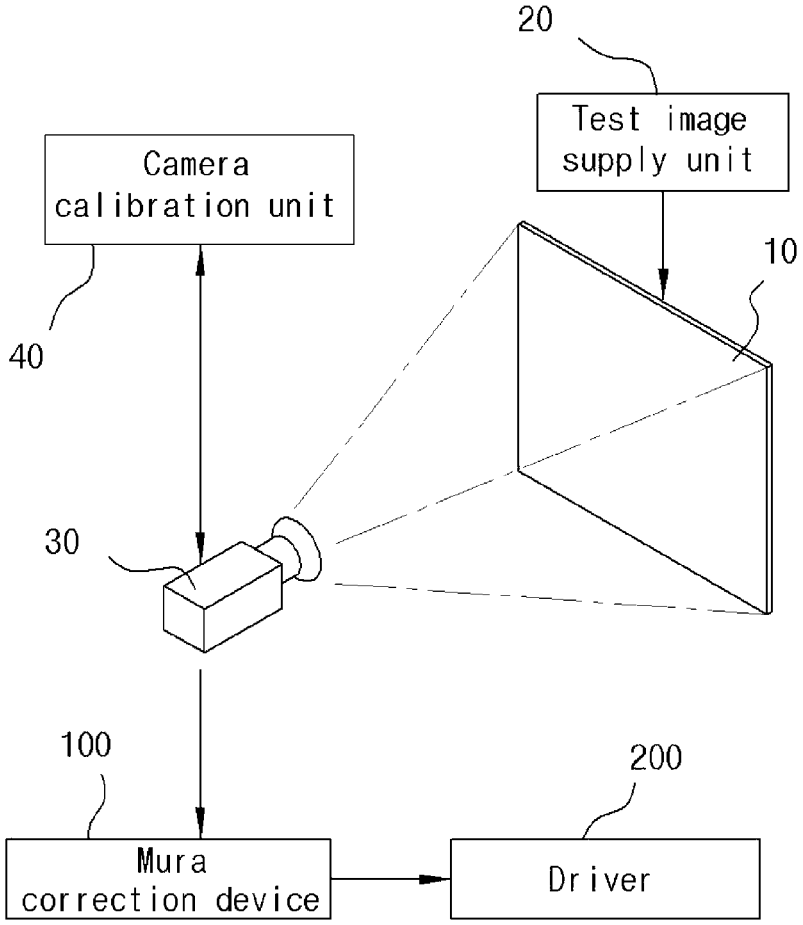
FIG. 1 is a block diagram illustrating a representation of an example of a Mura correction system in accordance with an embodiment of the disclosure.

Hereinafter, embodiments of the disclosure will be described in detail with reference to the accompanying drawings. The terms used herein and in the claims shall not be construed as being limited to general or dictionary meanings and shall be interpreted based on the meanings and concepts corresponding to technical aspects of the disclosure.

Embodiments described herein and configurations illustrated in the drawings are preferred embodiments of the disclosure, but do not represent all of the technical features of the disclosure. Thus, there may be various equivalents and modifications that can be made thereto at the time of filing the present application.

Mura in the form of a spot occurs in a pixel of a display image due to an error in a manufacturing process, or the like. The Mura defect of a display panel may be solved by accurately detecting a test image displayed on the display panel, analyzing the Mura in a detection image and correcting the Mura as a result of analyzing the Mura.

To this end, a Mura correction system in accordance with an embodiment of the disclosure may be illustrated as in FIG. 1.

Referring to FIG. 1, the Mura correction system includes a test image supply unit 20 which provides a test image for each gray level to a display panel 10, an image detection unit 30 which photographs the test image displayed on the display panel 10 and provides a photographed detection image, a camera calibration unit 40 which analyzes the detection image and thereby provides calibration information for allowing the image detection unit 30 to obtain an accurate detection image, and a Mura correction device 100 which performs Mura analysis on the detection image and generates Mura correction data corresponding to the Mura analysis. The Mura correction device 100 is configured to provide the Mura correction data to a driver 200.

In the above configuration, the display panel 10 may use an LCD panel or an OLED panel.

Figure 2A:
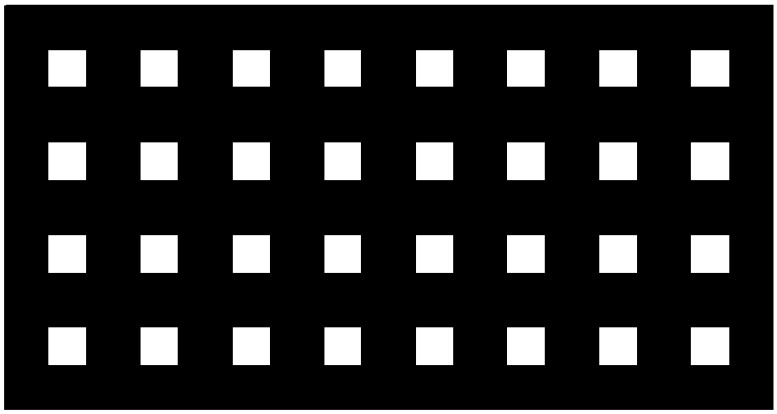
FIGS. 2A and 2B are diagrams illustrating representations of examples of test images.
Figure 2B:
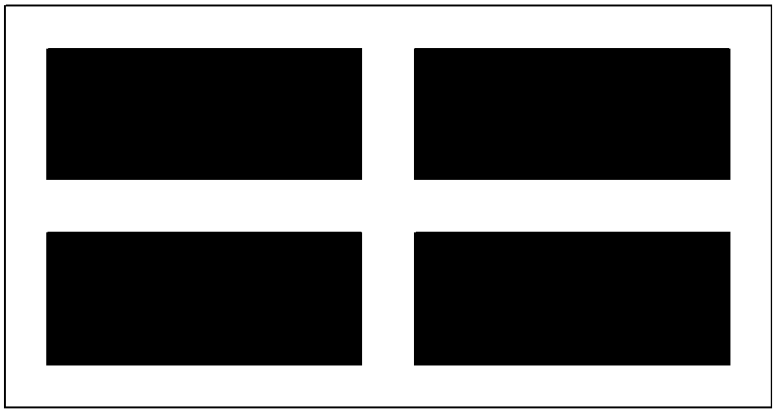

The test image supply unit 20 may provide test images as illustrated in FIGS. 2A and 2B. FIG. 2A illustrates that small square white patterns are formed in a matrix structure, and FIG. 2B illustrates that large square black patterns are formed in a matrix structure.

Unlike FIGS. 2A and 2B, a test image may be variously applied depending on the size or shape of the display panel 10. That is to say, in a test image, the shape, size, arrangement state or number of patterns may be determined depending on the size or shape of the display panel 10. Also, as the shape of the patterns included in the test image, not only a quadrangular shape but also various shapes may be applied and may be formed solely or in combination.

The test image supply unit 20 may separately provide a test image for calibrating the photographing state of the image detection unit 30 and a test image for analyzing the Mura of the display panel 10. The test image for calibrating the photographing state of the image detection unit 30 may be configured to have patterns that are easy to analyze the size, rotation and distortion of an image, and the test image for analyzing the Mura of the display panel 10 may be configured to easily obtain a pixel brightness value of the display panel 10 for each gray level. In the description of the embodiment of the disclosure, both the two cases will be collectively referred to as a test image.

The display panel 10 may receive a test image, that is, test image data, supplied from the test image supply unit 20, may drive pixels arranged in the form of a matrix depending on the test image data, and may display the test image through the driving of the pixels.

The image detection unit 30 may be understood as a camera which uses an image sensor, and obtains a detection image by photographing the test image displayed on the display panel 10, to analyze Mura. The photographing state of the image detection unit 30 may be variously set depending on the shape or size of the display panel 10. The image detection unit 30 may provide the photographed detection image, that is, detection image data, to the camera calibration unit 40 and the Mura correction device 100. The detection image data representing the detection image may be transmitted in formats corresponding to various protocols that may be received by the camera calibration unit 40 and the Mura correction device 100. In the following description, a detection image may be understood as detection image data.

The camera calibration unit 40 may be configured to display calibration information for calibrating the photographing state depending on a result of analyzing the detection image obtained by photographing the test image illustrated in FIG. 2A or 2B, on a separate display device (not illustrated) or to feed the calibration information back to the image detection unit 30.

In the case where the camera calibration unit 40 displays the calibration information on a separate display device, a user may check the calibration information and manually calibrate the photographing state of the image detection unit 30. In the case where the image detection unit 30 is configured to be able to automatically calibrate the photographing state by referring to the fed-back calibration information, the calibration of the photographing state may be automatically implemented as the camera calibration unit 40 feeds the calibration information back to the image detection unit 30.

The Mura analysis uses the detection image photographed by the image detection unit 30. Thus, the setting of the photographing state of the image detection unit 30 may exert substantial influence on a Mura analysis result.

According to the embodiment of the disclosure, by using the camera calibration unit 40 to objectively determine a case where the detection image does not maintain an original value of the test image and has a size change, rotation or distortion, the photographing state of the image detection unit 30 may be calibrated, and, through the calibration, an error that may occur by the image detection unit 30 may be reduced.

The Mura correction device 100 receives the detection image from the image detection unit 30, and performs Mura analysis on the detection image and generation of Mura correction data.

Figure 3:
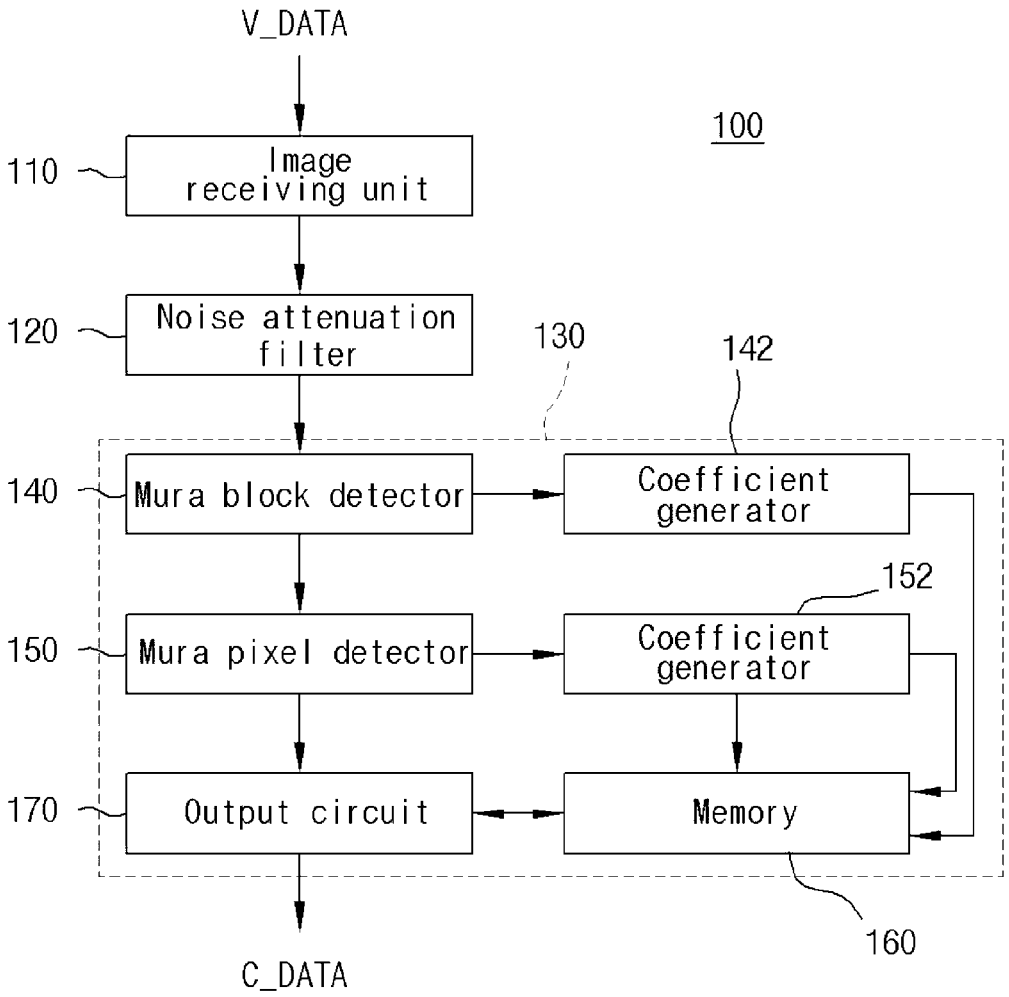
FIG. 3 is a block diagram illustrating a representation of an example of a Mura correction device of FIG. 1.

The Mura correction device 100 may be exemplified as illustrated in FIG. 3. In FIG. 3, the detection image is denoted by V_DATA, and the Mura correction data is denoted by C_DATA.

The Mura correction device 100 includes an image receiving unit 110 and a noise attenuation filter 120 which perform a preprocessing operation on the detection image V_DATA, and includes a Mura correction unit 130 for Mura correction of the preprocessed detection image V_DATA.

The image receiving unit 110 is an interface part for receiving the detection image V_DATA transmitted from the external image detection unit 30 and transmitting the received detection image V_DATA to the noise attenuation filter 120.

The noise attenuation filter 120 is to filter noise of the detection image V_DATA.

The detection image V_DATA provided from the image detection unit 30 has noise due to an electrical characteristic of the image sensor. The noise may serve as a factor that increases an error deviation in Mura analysis.

Therefore, the noise due to the electrical characteristic of the image sensor should be filtered from the detection image V_DATA. For this purpose, the noise attenuation filter 120 may be configured using a low pass filter. The low pass filter may be understood as commonly designating a Gaussian filter, an average filter, a median filter, and so forth.

The detection image V_DATA is inputted to the Mura correction unit 130 after passing through the image receiving unit 110 and the noise attenuation filter 120 for the preprocessing.

The Mura correction unit 130 receives the detection image V_DATA in which noise is attenuated by the noise attenuation filter 120, and detects a Mura block which has Mura, by determining a brightness value of each detection image V_DATA in a block unit including a plurality of pixels. The Mura correction unit 130 generates coefficient values of coefficients of a Mura correction equation as a quadratic equation for correcting a measurement value of the Mura block for each gray level to an average pixel brightness value of the display panel 10.

The Mura correction unit 130 sets a first coefficient, for example, a coefficient of the highest order, among the coefficients of the Mura correction equation to include adaptive range bits capable of changing a brightness representation range of the Mura block. The adaptive range bits are to set the coefficient value of the first coefficient such that the sum of a Mura measurement value of the Mura block and a Mura correction value approximates to the average pixel brightness value. The Mura correction unit 130 generates Mura correction data including a position value of the Mura block and the coefficient values of the coefficients of the Mura correction equation.

To this end, the Mura correction unit 130 includes a Mura block detector 140, a coefficient generator 142, a Mura pixel detector 150, a coefficient generator 152, a memory 160, and an output circuit 170.

The Mura block detector 140 receives the detection image V_DATA in which noise is attenuated by the noise attenuation filter 120, and detects a Mura block which has Mura, by determining a brightness value of each detection image V_DATA in a block unit including a plurality of pixels.

Figure 4:
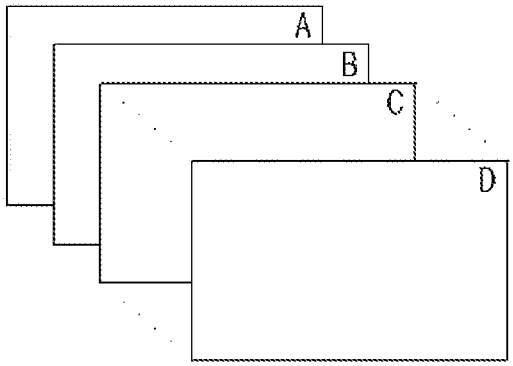
FIG. 4 is a diagram illustrating a representation of an example of detection images corresponding to test images for respective gray levels.

For example, the detection image V_DATA may be provided in frame units A, B, C, . . . , D having different gray level values, from the image detection unit 30, as illustrated in FIG. 4, and the Mura block detector 140 detects a Mura block in a block unit for each frame unit. FIG. 4 may be understood as representing frames of 18 gray levels, 48 gray levels, 100 gray levels and 150 gray levels as detection images V_DATA.

Figure 5:
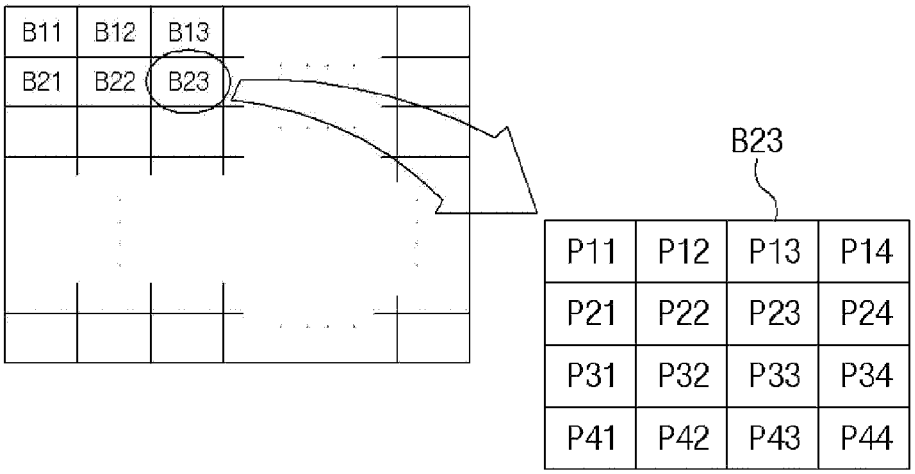
FIG. 5 is a representation of an example of a diagram to assist in the explanation of a method of analyzing a Mura block in a detection image.

For example, as illustrated in FIG. 5, the detection image V_DATA of each frame may be divided into a plurality of blocks which are arranged in the form of a matrix, and each block includes a plurality of pixels which are arranged in the form of a matrix. In FIG. 5, the reference symbols B11, B12, . . . , B23 are to separately represent respective blocks, and the reference symbols P11, P12, . . . , P44 are to separately represent respective pixels.

A Mura block may be determined in the block unit of FIG. 5. A Mura block may be determined based on an average brightness value for each gray level of the detection image V_DATA of the display panel 10. For instance, a block may have an average brightness value calculated by the brightness of the pixels included therein. Among blocks, a block having an average brightness value that deviates from a standard deviation by an average brightness value for each gray level of the display panel 10, by at least a predetermined level, may be determined as a Mura block.

The Mura block detector 140 generates a position value of a block determined as a Mura block. For example, the position value of the Mura block may be designated as a position value of a specific one of the pixels included in the Mura block. More specifically, when the block B23 of FIG. 5 is a Mura block and the coordinates of the pixel P11 of the block B23 are (5, 9), the position value of the Mura block may be designated as (5,9).

The Mura block detector 140 outputs data including the position value of the Mura block and the detection image V_DATA for the block, to the coefficient generator 142, and outputs information of the blocks for the detection image V_DATA (information including position information and the detection image V_DATA), to the Mura pixel detector 150.

The coefficient generator 142 generates coefficient values of coefficients of a Mura correction equation as a quadratic equation for correcting a measurement value of a Mura block for each gray level to an average pixel brightness value for each gray level of the display panel 10, and stores a position value of the Mura block and the coefficient values of the coefficients of the Mura correction equation in the memory 160. The position value of the Mura block and the coefficient values of the coefficients of the Mura correction equation are stored in the memory 160 to join with each other, and may be defined as Mura correction data.

In the embodiment of the disclosure, Mura correction for the Mura block is performed in the driver 200. In order for Mura correction, an approximate equation capable of accurately representing a brightness value of a Mura block for each gray level, that is, a Mura correction equation, is required. In the case where the Mura correction equation is determined, Mura correction may be accurately performed if only the coefficient values of the coefficients of the Mura correction equation for each gray level are determined.

In the embodiment of the disclosure, the Mura correction device 100 may generate the coefficient values of the Mura correction equation for Mura correction of the Mura block, as the Mura correction data. The driver 200 may have an algorithm which performs a calculation according to the Mura correction equation, and, by applying an input data (display data) to the Mura correction equation to which the coefficient values provided from the Mura correction device 100 are applied, may provide driving signals capable of displaying a screen with improved image quality in correspondence to the display data, to the display panel 10.

The disclosure is implemented to use a quadratic Mura correction equation to maximally approximate a brightness value of the Mura block for each gray level to an average pixel brightness value of the display panel 10. Therefore, the Mura correction device 100 generates the coefficient values of the coefficients of the Mura correction equation that is a quadratic equation, and the driver 200 applies the coefficient values of the coefficients to the Mura correction equation, corrects an input value (display data) by the Mura correction equation and outputs driving signals corresponding to the corrected display data.

Figure 6:
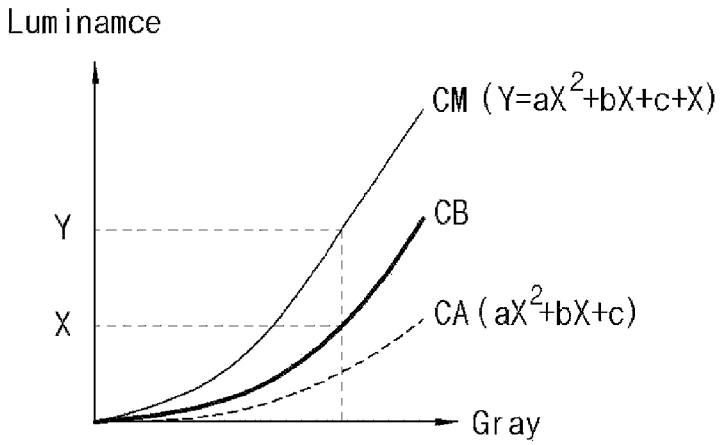
FIG. 6 is a graph illustrating a representation of an example of the relationship among a measurement value of the Mura block, a Mura correction value and an average pixel brightness value of a display panel, for each gray level.

The Mura correction equation will be described hereinbelow with reference to FIG. 6. In FIG. 6, the curve CM represents an average pixel brightness value of the display panel 10 for each gray level, the curve CA represents a Mura correction value for each gray level, and the curve CB represents a Mura measurement value for each gray level.

$$Y=aX^2+bX+c+X \quad \text{[Equation 1]}$$

In Equation 1, the Mura correction value for each gray level is expressed as $aX^2+bX+c$, the Mura measurement value for each gray level is expressed as X, and the average pixel brightness value of the display panel 10 for each gray level is expressed as Y. In Equation 1, X is the Mura measurement value for each gray level, that is, a gray level value of a gray level, and the coefficients of respective orders of the Mura correction equation are expressed as a, b and c.

Figure 7:
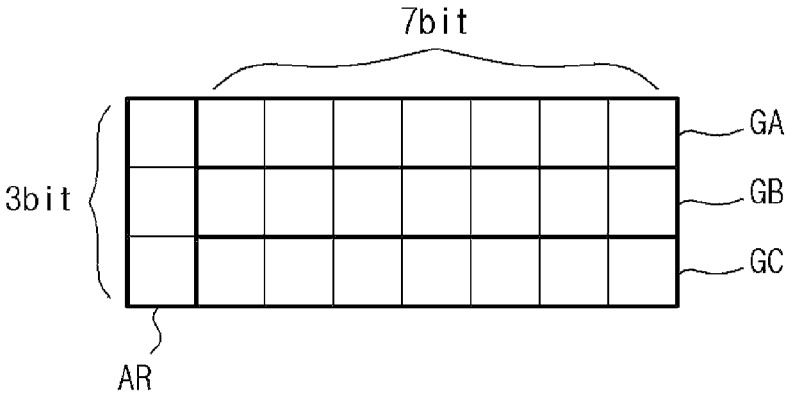
FIG. 7 is a diagram illustrating a representation of an example of a memory map which stores coefficient values of a Mura correction equation by applying an adaptive range.

In the embodiment of the disclosure, the coefficient values of the respective orders of the Mura correction equation may be stored using a memory map as illustrated in FIG. 7. The coefficients of the Mura correction equation may be set within a storage capacity range by the memory map.

Figure 8:
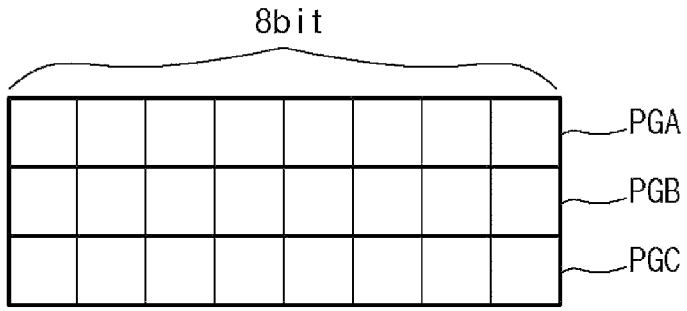
FIG. 8 is a diagram illustrating a representation of an example of a memory map which stores general coefficient values.

In a general case, the coefficient values of the respective orders of the Mura correction equation may be set to be expressed by 8 bits for example, and may be stored using a memory map as illustrated in FIG. 8. In FIG. 8, PGA denotes bits which express the coefficient value of the coefficient a, PGB denotes bits which express the coefficient value of the coefficient b, and PGC denotes bits which express the coefficient value of the coefficient c.

If a brightness value of the Mura block for each gray level does not change significantly, the coefficient values of the coefficients a, b and c may be sufficiently expressed by the 8 bits illustrated in FIG. 8. However, if a change in a brightness value of the Mura block for each gray level is substantial, it is difficult to sufficiently express the coefficient values of the coefficients a, b and c by 8 bits.

In order to solve this problem, the embodiment of the disclosure may be configured to set at least one designated coefficient among the coefficients, by applying an adaptive range. For instance, in order to solve the above-described problem of FIG. 8, the embodiment of the disclosure is configured to set the coefficient a of the highest order among the coefficients, by applying an adaptive range, as illustrated in FIG. 7.

Referring to FIG. 7, the coefficient a of the highest order among the coefficients is set to include adaptive range bits AR and basic range bits GA, and the remaining coefficients b and c are set to include basic range bits GB and GC. The basic range bits GA, GB and GC of the coefficients a, b and c may be set to have the same number of bits. The adaptive range bits AR are exemplified as 3 bits, and the basic range bits GA, GB and GC are exemplified as 7 bits.

On the other hand, the basic range bits GA, GB and GC of the respective coefficients may be set to have different numbers of bits. In other words, the number of the basic range bits GA of the coefficient a may be set to m1, the number of the basic range bits GB of the coefficient b may be set to m2, the number of the basic range bits GC of the coefficient c may be set to m3, and the number of the adaptive range bits AR may be set to n. Here, m1, m2, m3 and n are natural numbers.

Namely, the total capacity of the memory map is m1+m2+m3+n bits. In the total capacity, the remaining bits except m1+n bits allocated to the coefficient a may be allocated to express the basic range bits GB and GC of the coefficients b and the coefficient c. For instance, the coefficient a may be set to have the adaptive range bits AR of 2 bits (n=2) and the basic range bits GA of 7 bits (m1=7), the coefficient b may be set to have the basic range bits GB of 7 bits (m2=7), and the coefficient c may be set to have the basic range bits GC of 8 bits (m3=8).

The adaptive range bits AR described above are to change a brightness representation range of the Mura block so that the sum of the Mura measurement value of the Mura block and the Mura correction value approximates the average pixel brightness value. The brightness representation range of the Mura block determined by the change of the value of the adaptive range bits AR includes a resolution and a brightness value range. That is to say, the change of the adaptive range bits AR changes the brightness representation range, the resolution and the brightness value range of the Mura block.

In the embodiment of the disclosure, the coefficient a may be changed by changing the adaptive range bits AR. In other words, in the case where a change in the brightness value of the Mura block is substantial and thus a value of the Mura correction equation does not reach the average pixel brightness value of the display panel 10 through setting of the basic range bits of the coefficients a, b and c, the coefficient value of the coefficient a may be changed by changing the adaptive range bits AR. By the setting of the adaptive range bits AR, the coefficient a may have a coefficient value that is most approximate to an actually required coefficient value in the brightness representation range of the Mura block.

A method of setting the coefficient a of the Mura correction equation according to the embodiment of the disclosure to which an adaptive range is applied will be described below with reference to FIG. 9.

The coefficient a is expressed by the adaptive range bits AR and the basic range bits GA. In the case where the adaptive range bits AR are 3 bits, the coefficient a may have a value corresponding to a representation range of 8 steps, such as Range0 to Range7.

Figure 9:
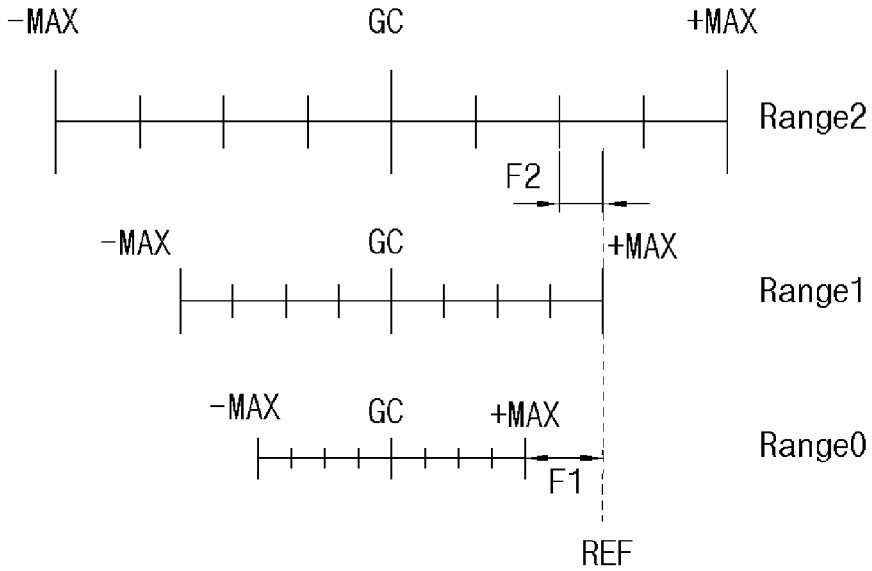
FIG. 9 is a representation of an example of a diagram to assist in the explanation of a method for obtaining an actually required coefficient by changing a representation range of the brightness value of a Mura block.

FIG. 9 illustrates that the brightness representation range of the Mura block is changed to Range0, Range1 and Range2, wherein the brightness representation range of the Mura block is narrowest in Range0 and is widest in Range2.

As the adaptive range bits AR have a higher value, the brightness representation range of the Mura block becomes wider. Namely, the brightness value range of the Mura block becomes wider, and the resolution of the Mura block becomes lower.

Table 1 shows the changes in the adaptive range bits AR of the coefficient a to represent 256 gray levels.

TABLE 1

| AR | −MAX~+MAX | Range of brightness value | Resolution |
|---|---|---|---|
| 0 | $-2^{-8}\sim2^{-8}$ | $2*2^{-8}$ | $(2*2^{-8})/256$ |
| 1 | $-2^{-9}\sim2^{-9}$ | $2*2^{-9}$ | $(2*2^{-9})/256$ |
| 2 | $-2^{-10}\sim2^{-10}$ | $2*2^{-10}$ | $(2*2^{-10})/256$ |

In Table 1, in the case where the adaptive range bits AR of the coefficient a are 3 bits, the value $(000)_2$ of the adaptive range bits AR is represented as 0 and corresponds to Range0 of FIG. 9, the value $(001)_2$ of the adaptive range bits AR is represented as 1 and corresponds to Range1 of FIG. 9, and the value $(010)_2$ of the adaptive range bits AR is represented as 2 and corresponds to Range2 of FIG. 9.

As in Table 1, when the value of the adaptive range bits AR is changed, the representation ranges, the brightness value ranges and the resolutions of the Range0, Range1 and Range 2 are changed as the value of the adaptive range bits AR becomes higher.

In the foregoing, Range0 corresponds to a maximum that may be represented by the basic range bits GA of the coefficient a.

In the case where the coefficient a is set to the representation range Range0 and a coefficient value REF that is actually required to approximate to the average pixel brightness value deviates from the representation range Range0 as illustrated in FIG. 9, an error F1 occurs.

In order to eliminate the error F1, in the embodiment of the disclosure, the value of the adaptive range bits AR may be changed.

In the case where the adaptive range bits AR have the value of 2, the average pixel brightness value that may be represented by the actually required coefficient value REF is included in the representation range Range2. However, an error F2 occurs between the average pixel brightness value that may be represented by the actually required coefficient value REF and a most approximate value among values that may be represented by the gray level values of representation range Range2.

In the case where the adaptive range bits AR have the value of 1, the average pixel brightness value that may be represented by the actually required coefficient value REF is included in the representation range Range1. The average pixel brightness value that may be represented by the actually required coefficient value REF corresponds to a maximum value+MAX of the representation range Range1.

In the case of FIG. 9 and Table 1 described above, according to the embodiment of the disclosure, the value of the adaptive range bits AR may be set to 1, and the coefficient a may have a coefficient value that is obtained by combining the value of the adaptive range bits AR corresponding to 1 and the maximum value of the basic range bits GA.

In the embodiment of the disclosure, the coefficient a of the Mura correction equation may be set as in the method described above with reference to FIG. 9 and Table 1.

In the case where a value that exactly corresponds to the desired coefficient value REF does not exist among the representation ranges corresponding to the changes of the adaptive range bits AR, the coefficient a may have a coefficient value that is obtained by combining the value of the adaptive range bits AR corresponding to a representation range in which a most approximate value exists and the maximum value of the basic range bits GA.

As described above, the coefficient generator 142 first determines the coefficient values of the coefficients a, b and c of the Mura correction equation by using the basic range bits GA, GB and GC. In the case where an average pixel brightness value for each gray level of the display panel 10 deviates from a value range by the Mura correction equation, the adaptive range bits AR of the coefficient a of the highest order are set such that the actually required coefficient value REF has a value most approximate to the average pixel brightness value.

When the coefficient values of the coefficients of the Mura correction equation for the Mura block are generated as described above, the coefficient generator 142 stores the position value of the Mura block and the coefficient values of the coefficients of the Mura correction equation, in the memory 160, as the Mura correction data. The position value of the Mura block and the coefficient values of the coefficients of the Mura correction equation are stored in the memory 160 in the form of a lookup table. The position value of the Mura block is utilized as an index. The position value of the Mura block and the coefficient values of the coefficients of the Mura correction equation are joined with each other such that the coefficient values of the coefficients of the Mura correction equation may be read from the position value of the Mura block.

In the Mura correction unit 130, as described above, the Mura block detector 140 detects the Mura block and thereby generates the position value of the Mura block, and the coefficient generator 142 generates the coefficient values of the coefficients of the Mura correction equation.

Thereafter, the Mura block detector 140 may output the detection image V_DATA to the Mura pixel detector 150 in a frame unit or a block unit. The Mura block detector 140 outputs the information of blocks for the detection image V_DATA of a general block and the Mura block (information including position information and the detection image V_DATA), to the Mura pixel detector 150.

A Mura pixel means a pixel which has a defect, and indicates a dot-shaped Mura having a pixel size that occurs due to an error in a manufacturing process, or the like.

The Mura pixel may be determined in a block unit of the detection image V_DATA. The Mura pixel may be detected based on the average pixel brightness value of the display panel 10 and a brightness value of an adjacent pixel.

More specifically, in the case where a brightness value of a Mura pixel such as a white dot Mura, a black dot Mura, and a black and white dot Mura is equal to or greater than a reference value set based on an average pixel brightness value, a brightness value of an adjacent pixel or both the average pixel brightness value and the brightness value of an adjacent pixel, the corresponding pixel is detected as a Mura pixel.

Figure 10:
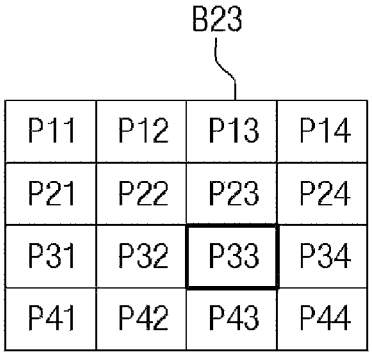
FIG. 10 is a representation of an example of a diagram to assist in the explanation of a method for detecting a Mura pixel in a block.

For instance, as illustrated in FIG. 10, the block B23 includes a plurality of pixels which are arranged in the form of a matrix.

In the block B23 of FIG. 10, a pixel having a brightness value equal to or greater than a reference value may be determined as a Mura pixel. FIG. 10 illustrates that the pixel P33 is determined as a Mura pixel.

The Mura pixel detector 150 generates a position value for the Mura pixel. In FIG. 10, in the case where the coordinates of the pixel P11 are (5, 9), the coordinates (7, 11) of the Mura pixel P33 may be generated as the position value.

The Mura pixel detection unit 150 may output data including the position value of the Mura pixel and the detection image V_DATA for the Mura pixel, to the coefficient generator 152, and may output the Mura block position value transferred from the Mura block detector 140 and the self-generated Mura pixel position value, to the output circuit 170.

The coefficient generator 152 generates coefficient values of coefficients of a Mura pixel correction equation as a quadratic equation for correcting a measurement value of the Mura pixel for each gray level to an average pixel brightness value, generates Mura pixel correction data including the position value of the Mura pixel and the coefficient values of the coefficients of the Mura pixel correction equation, and outputs the Mura pixel correction data to the memory 160.

In the embodiment of the disclosure, Mura correction for the Mura pixel is performed in the driver 200. In the same manner as the Mura correction for the Mura block, Mura correction for the Mura pixel requires an approximate equation capable of accurately representing a brightness value of the Mura pixel for each gray level, that is, the Mura pixel correction equation. In the case where the Mura pixel correction equation is determined, Mura correction for the Mura pixel may be accurately performed if only the coefficient values of the coefficients of the Mura pixel correction equation for each gray level are determined.

In the embodiment of the disclosure, the Mura correction device 100 may generate the coefficient values of the Mura pixel correction equation for Mura correction of the Mura pixel, as the Mura pixel correction data. The driver 200 may have an algorithm which performs a calculation according to the Mura pixel correction equation, and, by applying an input data (display data) to the Mura pixel correction equation to which the coefficient values provided from the Mura correction device 100 are applied, may provide driving signals capable of displaying the Mura pixel with improved image quality, to the display panel 10.

The disclosure is implemented to use the Mura pixel correction equation as a quadratic equation to maximally approximate a brightness value of the Mura pixel for each gray level to the average pixel brightness value of the display panel 10. Therefore, the Mura correction device 100 generates the coefficient values of the coefficients of the Mura pixel correction equation that is a quadratic equation, and the driver 200 applies the coefficient values of the coefficients to the Mura pixel correction equation, corrects an input value (display data) by the Mura pixel correction equation and outputs driving signals corresponding to the corrected display data to the Mura pixel.

The coefficient values of the coefficients of the Mura pixel correction equation for the Mura pixel may be generated in the same method as the coefficient values of the coefficients of the Mura correction equation.

In addition, setting the coefficient a of the highest order among the coefficients of the Mura pixel correction equation by applying an adaptive range may be configured in the same method as the Mura correction equation.

The highest-order coefficient of the Mura pixel correction equation for the Mura pixel may be set to include adaptive range bits capable of changing a brightness representation range of the Mura pixel such that the sum of a Mura measurement value of the Mura pixel and a Mura correction value approximates to the average pixel brightness value.

As such, the coefficients of the Mura correction equation and the Mura pixel correction equation may have the same format and may be set in the same method. Therefore, the detailed description of a method for generating the coefficient values of the coefficients of the Mura pixel correction equation will be omitted herein.

By the above descriptions, the memory 160 may store the Mura correction data including the position value of the Mura block and the coefficient values of the coefficients of the Mura correction equation provided from the coefficient generator 142 and the Mura pixel correction data including the position value of the Mura pixel and the coefficient values of the coefficients of the Mura pixel correction equation provided from the coefficient generator 152.

If the Mura block detection by the Mura block detector 140 and the Mura pixel detection by the Mura pixel detector 150 are completed, the output circuit 170 receives, from the memory 160, the Mura correction data corresponding to the position value of the Mura block transferred from the Mura block detector 140 and the Mura pixel correction data corresponding to the position value of the Mura pixel transferred from the Mura pixel detector 150, and provides the Mura correction data and the Mura pixel correction data to the driver 200.

The driver 200 stores the Mura correction data and the Mura pixel correction data in a storage location such as a flash memory configured therein.

The display panel 10 tested by the above-described method may be fabricated as a set with the driver 200 which stores therein the Mura correction data and the Mura pixel correction data. The driver 200 may correct display data for the Mura block or the Mura pixel by using the Mura correction data and the Mura pixel correction data.

As a result, the display panel 10 may display a screen with improved image quality by the correction of the display data.

While various embodiments have been described above, it will be understood to those skilled in the art that the embodiments described are by way of example only. Accordingly, the disclosure described herein should not be limited based on the described embodiments.

What is claimed is:

1. A Mura correction system comprising:

a test image supply unit configured to provide test images for gray levels, to a display panel;

an image detection unit configured to provide detection images obtained by photographing the test images displayed on the display panel; and a Mura correction device configured to detect a Mura block which has Mura, by checking, based on a brightness value, each detection image in a block unit including a plurality of pixels, generate coefficient values of coefficients of a Mura correction equation as a quadratic equation for correcting a measurement value of the Mura block for each gray level to an average pixel brightness value of the display panel, set a first coefficient among the coefficients of the Mura correction equation to include adaptive range bits capable of changing a brightness representation range of the Mura block such that a sum of a Mura measurement value for the Mura block and a Mura correction value approximates to the average pixel brightness value, and generate Mura correction data including a position value of the Mura block and the coefficient values of the coefficients of the Mura correction equation, wherein the Mura correction device changes a resolution and a brightness value range included in the brightness representation range of the Mura block, through a change in a value of the adaptive range bits.

2. The Mura correction system according to claim 1, wherein, in the Mura correction equation expressed by the sum of the Mura correction value $aX^2+bX+c$ and the Mura measurement value X, the Mura correction device generates coefficient values of coefficients of the Mura correction value, X is a gray level value of a gray level, and a, b and c are coefficients.

3. The Mura correction system according to claim 2, wherein the Mura correction device sets the coefficient a of a highest order of the Mura correction value as the first coefficient.

4. The Mura correction system according to claim 3, wherein the Mura correction device, sets the first coefficient to include the adaptive range bits and basic range bits, and sets remaining coefficients to include basic range bits, sets the coefficient b and the coefficient c with remaining bits except bits expressing the coefficient a among entire bits of a memory map allocated to express coefficients, and sets a value of the adaptive range bits to have a value most approximate to a coefficient value actually required for the first coefficient in a brightness representation range of the Mura block which changes.

5. The Mura correction system according to claim 1, wherein the Mura correction device detects a Mura pixel having at least a predetermined level of brightness difference in comparison with other pixels in the Mura block when checked based on the brightness value, generates coefficient values of coefficients of a Mura pixel correction equation as a quadratic equation for correcting a measurement value of the Mura pixel for each gray level to the average pixel brightness value, and further generates Mura pixel correction data including a position value of the Mura pixel and the coefficient values of the coefficients of the Mura pixel correction equation.

6. The Mura correction system according to claim 5, wherein the Mura correction device sets a second coefficient of a highest order among the coefficients to include adaptive range bits capable of changing a brightness representation range of the Mura pixel such that a sum of a Mura measurement value of the Mura pixel and a Mura correction value approximates to the average pixel brightness value.

7. The Mura correction system according to claim 6, wherein the Mura correction device sets the coefficients of the Mura correction equation and the Mura pixel correction equation to have the same format.

8. A Mura correction system comprising:

a Mura correction device configured to receive a detection image corresponding to a test image for each gray level of a display panel, and generate Mura correction data for a Mura block, the Mura correction device comprising:

a Mura block detector configured to detect a Mura block which has Mura, by checking, based on a brightness value, each detection image in a block unit including a plurality of pixels;

a first coefficient generator configured to generate coefficient values of coefficients of a Mura correction equation as a quadratic equation for correcting a measurement value of the Mura block for each gray level to an average pixel brightness value of the display panel, and set a first coefficient among the coefficients of the Mura correction equation to include adaptive range bits capable of changing a brightness representation range of the Mura block such that a sum of a Mura measurement value for the Mura block and a Mura correction value approximates to the average pixel brightness value;

a memory configured to store Mura correction data including a position value of the Mura block and the coefficient values of the coefficients of the Mura correction equation; and an output circuit configured to output the Mura correction data to a driver for driving the display panel, wherein the first coefficient generator changes a resolution and a brightness value range included in the brightness representation range of the Mura block, through a change in a value of the adaptive range bits.

9. The Mura correction system according to claim 8, wherein, in the Mura correction equation expressed by the sum of the Mura correction value $aX^2+bX+c$ and the Mura measurement value X, the first coefficient generator generates coefficient values of coefficients of the Mura correction value, X is a gray level value of a gray level, and a, b and c are coefficients.

10. The Mura correction system according to claim 9, wherein the first coefficient generator sets the coefficient a of a highest order of the Mura correction value as the first coefficient.

11. The Mura correction system according to claim 10, wherein the first coefficient generator, sets the first coefficient to include the adaptive range bits and basic range bits, and sets remaining coefficients to include basic range bits, sets the coefficient b and the coefficient c with remaining bits except bits expressing the coefficient a among entire bits of a memory map allocated to express coefficients, and sets a value of the adaptive range bits to have a value most approximate to a coefficient value actually required for the first coefficient in a brightness representation range of the Mura block which changes.

12. The Mura correction system according to claim 8, wherein the Mura correction device comprises:

a Mura pixel detector configured to detect a Mura pixel which has at least a predetermined level of brightness difference in comparison with other pixels in the Mura block when checked based on the brightness value; and a second coefficient generator configured to generate coefficient values of coefficients of a Mura pixel correction equation as a quadratic equation for correcting a measurement value of the Mura pixel for each gray level to the average pixel brightness value, and generate Mura pixel correction data including a position value of the Mura pixel and the coefficient values of the coefficients of the Mura pixel correction equation, wherein the memory further stores the Mura pixel correction data including the position value of the Mura pixel and the coefficient values of the coefficients of the Mura pixel correction equation, and wherein the output circuit further outputs the Mura pixel correction data to the driver.

13. The Mura correction system according to claim 12, wherein the second coefficient generator sets a second coefficient of a highest order among the coefficients to include adaptive range bits capable of changing a brightness representation range of the Mura pixel such that a sum of a Mura measurement value of the Mura pixel and a Mura correction value approximates to the average pixel brightness value.

* * * * *